US009229347B2

(12) United States Patent
Kishida et al.

(10) Patent No.: US 9,229,347 B2
(45) Date of Patent: Jan. 5, 2016

(54) CARRIER FOR TWO-COMPONENT DEVELOPER, TWO-COMPONENT DEVELOPER USING THE CARRIER, AND PROCESS CARTRIDGE AND IMAGE FORMING METHOD AND APPARATUS USING THE TWO COMPONENT DEVELOPER

(71) Applicants: Hiroyuki Kishida, Shizuoka (JP); Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Toyoaki Tano, Shizuoka (JP); Kenichi Mashiko, Shizuoka (JP)

(72) Inventors: Hiroyuki Kishida, Shizuoka (JP); Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Toyoaki Tano, Shizuoka (JP); Kenichi Mashiko, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/107,522

(22) Filed: Dec. 16, 2013

(65) Prior Publication Data

US 2014/0227638 A1 Aug. 14, 2014

(30) Foreign Application Priority Data

Feb. 13, 2013 (JP) ..... 2013-025428

(51) Int. Cl.

| | |
|---|---|
| ***G03G 9/00*** | (2006.01) |
| ***G03G 9/10*** | (2006.01) |
| ***G03G 13/08*** | (2006.01) |
| ***G03G 9/113*** | (2006.01) |
| ***G03G 15/08*** | (2006.01) |

(52) U.S. Cl.

CPC ..... *G03G 13/08* (2013.01); *G03G 9/1131* (2013.01); *G03G 9/1136* (2013.01); *G03G 9/1139* (2013.01); *G03G 15/0818* (2013.01)

(58) Field of Classification Search

CPC ..... G03G 9/113; G03G 9/1138

USPC ..... 430/114.35, 111.4, 111.35

See application file for complete search history.

(56) References Cited

U.S. PATENT DOCUMENTS

| | | | | |
|---|---|---|---|---|
| 6,306,552 | B1 * | 10/2001 | Yasunaga et al. | 430/111.4 |
| 8,512,928 | B2 | 8/2013 | Kishida et al. | |
| 8,652,735 | B2 | 2/2014 | Sakata et al. | |
| 2006/0251979 | A1 * | 11/2006 | Watanabe et al. | 430/108.6 |
| 2011/0229817 | A1 * | 9/2011 | Yamada et al. | 430/111.35 |

FOREIGN PATENT DOCUMENTS

| | | |
|---|---|---|
| JP | 55-127569 | 10/1980 |
| JP | 55-157751 | 12/1980 |
| JP | 56-140358 | 11/1981 |
| JP | 57-096355 | 6/1982 |
| JP | 57-096356 | 6/1982 |
| JP | 58-207054 | 12/1983 |
| JP | 61-110161 | 5/1986 |
| JP | 62-273576 | 11/1987 |
| JP | 2000-172017 | 6/2000 |
| JP | 2005-134708 | 5/2005 |
| JP | 2005-309184 | 11/2005 |
| JP | 2006-259179 | 9/2006 |
| JP | 2007-058124 | 3/2007 |
| JP | 2008-026582 | 2/2008 |
| JP | 2008-040271 | 2/2008 |
| JP | 2009-053545 | 3/2009 |
| JP | 2009-244570 | 10/2009 |
| JP | 2009-300531 | 12/2009 |
| JP | 2011-180296 | 9/2011 |
| JP | 2011-253007 | 12/2011 |
| JP | 2012-058483 | 3/2012 |
| JP | 2012-063718 | 3/2012 |

OTHER PUBLICATIONS

U.S. Appl. No. 13/960,965, filed Aug. 7, 2013. Inventor Yaguchi, et al.

* cited by examiner

*Primary Examiner* — Thorl Chea

(74) *Attorney, Agent, or Firm* — Oblon, McClelland, Maier & Neustadt, L.L.P.

(57) ABSTRACT

A carrier for use in a two-component developer for developing an electrostatic latent image is provided. The carrier includes a particulate magnetic core; and a cover layer located on a surface of the particulate magnetic core and including a resin and a particulate electroconductive material. The carrier has a BET specific surface area of from 0.8 to 1.6 $m^2/g$.

8 Claims, 4 Drawing Sheets

CARRIER FOR TWO-COMPONENT DEVELOPER, TWO-COMPONENT DEVELOPER USING THE CARRIER, AND PROCESS CARTRIDGE AND IMAGE FORMING METHOD AND APPARATUS USING THE TWO COMPONENT DEVELOPER

CROSS-REFERENCE TO RELATED APPLICATIONS

This patent application is based on and claims priority pursuant to 35 U.S.C. §119 to Japanese Patent Application No. 2013-025428 filed on Feb. 13, 2013 in the Japan Patent Office, the entire disclosure of which is hereby incorporated by reference herein.

TECHNICAL FIELD

This disclosure relates to a carrier for use in two-component developer, and to a two-component developer for developing an electrostatic latent image, which uses the carrier. In addition, this disclosure relates to an image forming method, a process cartridge, and an image forming apparatus using the two-component developer.

BACKGROUND

Electrophotographic image formation typically includes the following processes:

(1) forming an electrostatic latent image on an image bearing member such as photoreceptor;

(2) adhering a charged toner to the electrostatic latent image to form a toner image on the image bearing member:

(3) transferring the toner image onto a recording medium optionally via an intermediate transfer medium; and (4) fixing the toner image to the recording medium to output an image.

Recently, electrophotographic image forming apparatuses have been rapidly changed from monochrome image forming apparatuses to full color image forming apparatuses, and the market scale of full color image forming apparatuses has been expanded.

In full color image formation, three color images such as yellow, magenta and cyan color toner images or four color images such as yellow, magenta, cyan and black color toner images are overlaid to form a full color image. In order to produce a clear full color image having good color reproducibility, it is preferable to smooth the surface of a fixed toner image to prevent light scattering on the surface of the image. Therefore, full color images formed by conventional full color image forming apparatuses typically have a medium glossiness to a high glossiness in a range of from 10 to 50%.

With respect to the fixing method, contact heat fixing methods including pressing a toner image with a fixing member such as a heated roller or belt having a smooth surface have been mainly used. Such contact heat fixing methods have advantages such that the heat efficiency is high; high speed fixing can be performed; and a good combination of glossiness and transparency can be imparted to color toner images. However, since the heated fixing member is contacted with a toner image on a recording medium upon application of pressure thereto and is then released from the toner image, an offset problem in that part of the toner image is adhered to the surface of the fixing member, followed by re-adhering to another portion of the recording medium or the following recording medium is often caused.

In order to prevent occurrence of the offset problem, fixing methods using a fixing roller whose surface is made of a material having good releasability such as silicone rubbers and fluorine containing resins and on which an oil such as silicone oils is applied to prevent fixation of toner thereon have been typically used. Such fixing methods can prevent occurrence of the offset problem, but have a drawback in that the fixing device has to be equipped with an oil applicator, and therefore the size of the fixing device increases.

Therefore, when monochromatic images are formed, an oil-less fixing system which applies no oil to the fixing member or an oil micro-coating fixing method which includes applying a small amount of oil to the fixing member is used. In such fixing methods, a toner, which includes a releasing agent and which has a large viscoelasticity when melted is used to prevent occurrence of internal fracturing of the melted toner.

Similarly to the monochromatic image formation, an oil-less fixing method is also used for full color image forming apparatus to miniaturize the fixing device of the apparatus and to simplify the structure of the fixing device. However, in full color image formation, the viscoelasticity of the melted toner has to be decreased to smooth the surface of the fixed toner image. Therefore, the offset problem tends to be caused relatively easily in full color image formation compared to a case of monochromatic image formation in which non-glossy images are formed. Accordingly, it is difficult to use an oil-less fixing method for full color image formation. In addition, when a toner including a releasing agent is used, the adhesiveness of the toner to image bearing members increases, thereby deteriorating the transferring property of toner images to recording media. Further, a toner filming problem in that a toner film is formed on an image bearing member and a carrier, and thereby the charging property of the image bearing member and the carrier is deteriorated, resulting in deterioration of the durability of the image bearing member and the carrier tends to be caused.

In order to prevent formation of a toner film on a carrier, to allow the carrier to have an even surface, to prevent oxidation of the surface of the carrier, to enhance the moisture resistance of the carrier, to extend the life of the developer, to prevent the carrier from adhering to image bearing members, to protect image bearing members (photoreceptors) from being scratched or abraded by the carrier, to control the polarity of the charged toner, and to control the charge quantity of the toner, the carrier is typically coated with a fluorine-containing resin or a silicone resin.

Specific examples of the carrier coated with a resin having low surface energy include the following.

(1) a carrier which is disclosed in JP-S55-127569-A and which is covered with a layer including a room-temperature curable silicone resin and a positively chargeable nitrogen-containing resin;

(2) a carrier which is disclosed in JP-S55-157751-A and which is covered with a material including at least a modified silicone resin;

(3) a carrier which is disclosed in JP-S56-140358-A and which is covered with a resin layer including a room-temperature curable silicone resin and a styrene-acrylic resin;

(4) a carrier which is disclosed in JP-S57-096355-A and in which the core thereof is covered with at least two layers each including a silicone resin, wherein the layers have poor adhesiveness to each other;

(5) a carrier which is disclosed in JP-S57-096356-A and in which the core thereof is covered with at least two layers each including a silicone resin;

(6) a carrier which is disclosed in JP-S58-207054-A and which is covered with a silicone resin including silicon carbide;

(7) a positively chargeable carrier which is disclosed in JP-S61-110161-A and which is coated with a material having a critical surface tension of not greater than 20 dyn/cm; and (8) a developer which is disclosed in JP-S62-273576-A and which includes a carrier coated with a material including a fluorinated alkyl acrylate and a toner including a chromium-containing azo dye.

In addition, in order to impart good charging property to toner, carrier having a small particle diameter is typically used. However, such a small carrier tends to easily cause a carrier adhesion problem in that the carrier adheres to an image bearing member such as photoreceptors, thereby damaging the image bearing member and the fixing roller used. In order to prevent occurrence of the carrier adhesion problem, a material having high magnetic force is typically used for the core of such a small carrier.

Carriers having a small BET (Brunauer, Emmett, Teller) specific surface area and using a core having high magnetic force have been disclosed by JP-2005-309184-A, JP-4544099-B1 (JP-2007-058124-A), JP-4621639-B1 (JP-2008-026582-A), and JP-2008-040271-A.

However, these carriers have low toner bearing and feeding ability. Therefore, when an image such that a solid image is present in a half tone image is formed, a halo image such that a portion of the half tone electrostatic image around the solid image is printed as a white image as illustrated in FIG. 5B due to the edge effect (i.e., emphasis of the portion of the half tone electrostatic image), and/or such a ghost image as illustrated in FIG. 4B is often formed.

JP-2011-253007-A discloses a coated carrier having a large BET specific surface area. The coat layer of the carrier does not include a particulate electroconductive material.

JP-2006-259179-A, JP-2009-053545-A, and JP-2009-300531-A have disclosed coated carriers which are allowed to have a larger BET specific surface area than the cores thereof to increase the area of the contact portions of the carrier with toner while enhancing the charge imparting ability and toner bearing ability of the carrier.

Recently, image forming apparatuses are urged to perform high speed recording while reducing environmental burdens and costs per one print. Therefore, a need exists for a carrier having better durability than ever. In addition, there is a need for an electrophotographic image forming apparatus which can produce high quality images while having good durability so that the image forming apparatus can be used for the production printing field. Therefore, a need exists for a carrier which can be used for the developer of such a high-speed and long-life image forming apparatus.

SUMMARY

As an aspect of this disclosure, a carrier for two-component developer is provided which includes a particulate magnetic core, and a cover layer located on a surface of the particulate magnetic core and including a resin and a particulate electroconductive material and which has a BET specific surface area of from 0.8 to 1.6 $m^2/g$.

As another aspect of this disclosure, a two-component developer is provided which includes the above-mentioned carrier, and a toner.

As another aspect of this disclosure, an image forming apparatus is provided which includes an image bearing member to bear an electrostatic latent image; a charger to charge the image bearing member; an irradiator to irradiate the charged image bearing member with light to form the electrostatic latent image on the image bearing member; a developing device to develop the electrostatic latent image with the above-mentioned two-component developer to form a toner image on the image bearing member; a transferring device to transfer the toner image onto a recording medium; and a fixing device to fix the toner image to the recording medium.

As another aspect of this disclosure, a process cartridge is provided which includes an image bearing member to bear an electrostatic latent image on a surface thereof; a developing device to develop the electrostatic latent image with the above-mentioned two-component developer to form a toner image on the image bearing member; and a cleaner to clean the surface of the image bearing member.

As another aspect of this disclosure, an image forming method is provided which includes forming an electrostatic latent image on a surface of an image bearing member; developing the electrostatic latent image with the above-mentioned two-component developer to form a toner image on the image bearing member; transferring the toner image onto a recording medium; and fixing the toner image to the recording medium.

The aforementioned and other aspects, features and advantages will become apparent upon consideration of the following description of the preferred embodiments taken in conjunction with the accompanying drawings.

DETAILED DESCRIPTION

Figure 1:
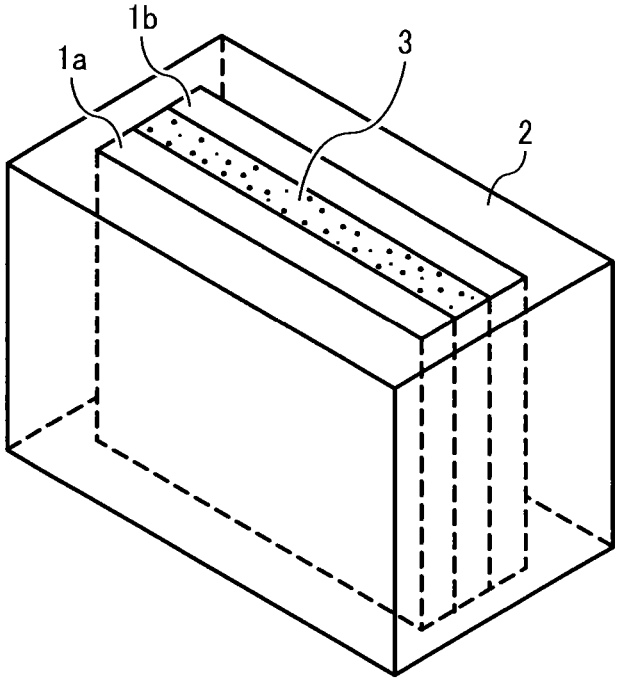
FIG. 1 is a schematic view illustrating a cell used for measuring the volume resistivity of a carrier.

Since the carrier disclosed in JP-2011-253007-A mentioned above does not include such a particulate electroconductive material as mentioned later, the carrier has insufficient abrasion resistance.

In addition, the BET specific surface area of the carriers disclosed in JP-2011-253007-A, JP-2006-259179-A, JP-2009-053545-A, and JP-2009-300531-A mentioned above is not sufficiently large for performing high speed development in recent years, and therefore it is necessary for further increasing the BET specific surface area.

The object of this disclosure is to provide a carrier for use in two-component developer, which has sufficient toner supplying ability for high speed development, and to provide a two-component developer for use in high speed development.

Initially, the carrier of this disclosure will be described in detail.

The carrier of this disclosure includes a particulate magnetic core and a cover layer (hereinafter sometimes referred to as a resinous cover layer) located on the surface of the particulate magnetic core and including a resin and a particulate electroconductive material, and has a BET specific surface area of from 0.8 to 1.6 $m^2/g$.

The BET specific surface area is an indicator of condition of the surface of a material. When a material has smooth surface, the material has a low BET specific surface area, and when a material has rough surface, the material has a high BET specific surface area. Since toner is charged by being contacted with a surface of a carrier, the BET specific surface area of the carrier has important implications in charging toner.

Since the carrier of this disclosure has a resinous cover layer including a resin and a particulate electroconductive material, the impact resistance of the carrier can be enhanced, thereby enhancing the durability of the carrier. In addition, since the surface of the carrier hardly changes, the carrier can maintain good charging ability over a long period of time.

The particulate electroconductive material included in the resinous cover layer mainly serves as a resistance adjuster, and also serves as an abrasion resistance imparting agent. Specifically, by using a particulate electroconductive material, which includes a core of metal or metal oxide coated with an electroconductive material, for the resinous cover layer, the carrier has projections having high hardness on the surface thereof. Therefore, when the developer is agitated in a developing device (i.e., when carrier particles are agitated), the projections on the surface of the carrier particles, which have high hardness, mainly collide with each other, and therefore the surface of the carrier can maintain good abrasion resistance.

The surface area of the carrier of this disclosure is much greater than those of conventional coated carriers to such an extent that the BET specific surface area is from 0.8 to 1.6 $m^2/g$. The BET specific surface area is preferably from 0.9 to 1.5 $m^2/g$.

When the BET specific surface area is less than 0.8 $m^2/g$, the abrasion decreasing effect of the particulate electroconductive material such that the particulate electroconductive material decreases abrasion of the resinous cover layer is hardly produced. Therefore, a problem such that the resinous cover layer is abraded, thereby decreasing the resistance of the carrier, resulting in occurrence of scattering of the carrier is caused. In contrast, when the BET specific surface area is greater than 1.6 $m^2/g$, a spent toner problem such that a film of toner is formed on the resinous cover layer, thereby deteriorating the charging ability of the carrier, resulting in formation of uneven density toner images is caused.

The BET specific surface area of the carrier can be adjusted by adjusting the BET specific surface area of the core of the carrier, and the particle diameter and the content of the particulate electroconductive material. The BET specific surface area of a carrier can be measured, for example, by a micromeritics automatic surface area and porosimetry analyzer, TRISTAR 3000 from Shimadzu Corp.

Next, the particulate electroconductive material will be described. The particulate electroconductive material in the resinous cover layer preferably has an average primary particle diameter of from 0.35 μm to 0.65 μm. When the average primary particle diameter is less than 0.35 μm, the electroconductive material tends to easily form agglomerated particles, thereby making it difficult to disperse the electroconductive material so as to achieve a single-particle state. When agglomerated particles of the electroconductive material are present on the surface of the resinous cover layer of the carrier, the particles are easily released from the resinous cover layer. In contrast, when the average primary particle diameter is greater than 0.65 μm, the electroconductive material is easily released from the resinous cover layer by a stress when the carrier is agitated in a developing device.

The average particle diameter of a particulate electroconductive material can be measured, for example, by one of instruments, NANOTRACK UPA Series from Nikkiso Co., Ltd.

The content of a particulate electroconductive material in the carrier is from 0.016 to 0.040 parts by weight based on 1 part by weight of the core. When the content is less than 0.016 parts by weight, the resinous cover layer is easily abraded after repeated use, thereby decreasing the resistance of the carrier, resulting in occurrence of scattering of the carrier. In contrast, when the content is greater than 0.040 parts by weight, the spent toner problem tends to be easily caused, thereby forming uneven density images.

The specific resistance (volume resistivity) of powder of the particulate electroconductive material is preferably from 3 to 20 Ω·cm. The powder specific resistance of the carrier is typically adjusted by adjusting the content of the particulate electroconductive material, which serves as a main resistance adjuster. Therefore, when the powder specific resistance of the particulate electroconductive material is less than 3 Ω·cm, the content of the particulate electroconductive material has to be decreased. In this case, the durability of the carrier deteriorates. In addition, since the coating amount of an electroconductive material such as phosphorus-doped tin oxide increases, the particle diameter of the particulate electroconductive material increases. In this case, particles of the electroconductive material are easily released from the surface of the carrier when particles of the carrier are collided with each other.

In contrast, when the powder specific resistance is greater than 20 Ω·cm, the content of the particulate electroconductive material has to be increased, thereby causing a problem in that the resinous cover layer includes agglomerated particles of the electroconductive material, thereby causing a problem in that the particulate electroconductive material is released from the resinous cover layer.

The powder specific resistance of a particulate electroconductive material can be measured, for example, by a LCR meter from Hewlett Packard Japan, Ltd.

Specific examples of the particulate electroconductive material include metal powders, and powders of titanium oxide, tin oxide, zinc oxide, alumina, indium tin oxide (ITO), titanium oxide whose surface is treated with a carbon- or antimony-doped indium oxide, and alumina whose surface is treated with ITO or phosphorus-doped tin oxide. These can be used alone or in combination.

Since the above-mentioned particulate electroconductive materials have good toughness, the particulate electroconductive materials have good resistance to external forces. Therefore, even when the carrier is repeatedly used over a long period of time, the particulate electroconductive material in the resinous cover layer is not cracked, and thereby the cover layer is hardly abraded. Accordingly, the carrier can maintain good durability over a long period of time.

The particulate electroconductive material may be subjected to a surface treatment. By using such a surface-treated particulate electroconductive material, the particulate electroconductive material can be strongly fixed to the resinous cover layer, thereby making it possible for the particulate electroconductive material to satisfactorily produce the resistance adjusting effect. Specific examples of such a surface treatment agent include amino type silane coupling agents, methacryloxy type silane coupling agents, vinyl type silane coupling agents, and mercapto type silane coupling agents.

Next, the resinous cover layer will be described.

The resinous cover layer fixes the particulate electroconductive material to the surface of the core while covering the surface of the core together with the particulate electroconductive material to adjust the resistance of the carrier.

Combinations of an acrylic resin and a silicone resin are preferably used as the resin of the resinous cover layer.

Since acrylic resins have good adhesiveness, acrylic resins can strongly fix a particulate electroconductive material having a relatively large particle to the surface of the core. In addition, since acrylic resins have low brittleness (i.e., acrylic resins are not brittle), the cover layer has good abrasion resistance. However, since acrylic resins have high surface energy, the above-mentioned spent toner problem is often caused if the toner used has a tendency to easily cause the spend toner problem.

Therefore, by using a silicone resin, which has low surface energy, together with an acrylic resin, occurrence of the spent toner problem can be prevented.

However, since silicone resins have poor adhesiveness and are brittle, silicone resins have poor abrasion resistance. Therefore, it is preferable to balance the properties of acrylic resins and silicone resins to prepare a resinous cover layer, which has good abrasion resistance and which hardly causes the spent toner problem. The weight ratio (A/S) of an acrylic resin (A) to a silicone resin (S) in the resinous cover layer is preferably from 100/250 to 100/500, and more preferably from 100/300 to 100/400, although the weight ratio changes depending on the properties of the acrylic resin and the silicone resin used.

Any known acrylic resins can be used for the resinous cover layer. Among these acrylic resins, silicone-modified acrylic resins are preferable because the resins have good compatibility with silicone resins, and hardly cause the toner spent problem.

It is possible to use only an acrylic resin for the resinous cover layer. However, in this case, it is preferable for the acrylic resin to include at least one component having crosslinking ability. Specific examples of such a component having crosslinking ability include amino resins and acidic catalysts, but are not limited thereto.

Specific examples of such amino resins include guanamine resins and melamine resins, but are not limited thereto.

Any known acidic catalysts can be used as long as the acidic catalysts perform catalysis. Specific examples thereof include acidic catalysts having a reactive group such as a perfect alkylation type group, a methylol group, an imino group, and a methylol/imino group, but are not limited thereto.

The acrylic resin in the resinous cover layer is preferably crosslinked with an amino resin. Such an acrylic resin crosslinked with an amino resin has a proper elasticity while preventing adhesion of the resinous cover layer on a carrier particle to the cover layer of another carrier particle.

The amino resin is not particularly limited, but melamine resins and benzoguanamine resins are preferable because of being capable of imparting good charging ability to the carrier. When it is necessary to adjust the charging ability to be imparted to the carrier, a combination of a melamine resin and/or a benzoguanamine resin with another amino resin can be used.

Acrylic resins having a hydroxyl group and/or a carboxyl group are preferably used when crosslinked with an amino resin, and acrylic resins having a hydroxyl group are more preferable because adhesion of the resinous cover layer with a core and a particulate electroconductive material can be enhanced while enhancing the dispersion stability of a particulate electroconductive material. In this case, the hydroxyl value of the acrylic resin is preferably not less than 10 mgKOH/g, and more preferably not less than 20 mgKOH/g.

Any known silicone resins can be used for the above-mentioned silicone resin. Specific examples of such silicone resins include straight silicone resins, and alkyd-, polyester-, epoxy- or urethane-modified silicone resins.

Specific examples of the straight silicone resins include KR271, KR255 and KR152 from Shin-Etsu Chemical Co., Ltd.; and SR2400, SR2406 and SR2410 from Dow Corning Toray Silicone Co., Ltd. In this regard, a straight silicone resin can be used alone, and it is possible to use another component capable of performing a crosslinking reaction and/or another component capable of adjusting the charge quantity of the toner in combination with such a straight silicone resin.

Specific examples of the above-mentioned modified silicone resins include KR206 (alkyd-modified silicone resin), KR5208 (acrylic-modified silicone resin), ES1001N (epoxy-modified silicone resin) and KR305 (urethane-modified silicone resin) from Shin-Etsu Chemical Co., Ltd.; and SR2115 (epoxy-modified silicone resin) and SR2110 (alkyd-modified silicone resin) from Dow Corning Toray Silicone Co., Ltd.

The cover layer coating liquid used for forming the resinous cover layer preferably includes a silane coupling agent to enhance the dispersion stability of the particulate electroconductive material to be dispersed in the resinous cover layer.

Specific examples of such a silane coupling agent include, but are not limited thereto, γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl)ammonium chloride. These can be used alone or in combination.

Specific examples of marketed products of such silane coupling agents include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920 and Z-6940 from Dow Corning Toray Silicone Co., Ltd.

The added amount of a silane coupling agent is preferably from 0.1 to 10% by weight based on the weight of the silicone resin used. When the added amount is less than 0.1% by weight, adhesiveness between the silicone resin, and the core and the particulate electroconductive material deteriorates, thereby often causing release of the cover layer from the core after repeated use. In contrast, when the added amount is greater than 10% by weight, the above-mentioned toner filming problem is often caused.

The cover layer coating liquid can include a condensation polymerization catalyst such as titanium-containing catalysts, tin-containing catalysts, zirconium-containing catalysts, and aluminum-containing catalysts. Among these catalysts, titanium-containing catalysts are preferable because of having a good catalytic ability. Among titanium-containing catalysts, titanium diisopropoxybis(ethylacetoacetate) is more preferable because of producing a good effect to accelerate the condensation reaction of a silanol group while being hardly deactivated.

By applying a resin composition liquid, in which the above-mentioned particulate electroconductive material is dispersed, on the surface of the particulate core, the particulate electroconductive material can be well adhered to the surface of the particulate core. The weight ratio (P/R) of a particulate electroconductive material (P) to a resin component (R) in the cover layer coating liquid is preferably from 30/100 to 200/100, and more preferably from 40/100 to 150/100.

The resinous cover layer covers substantially the entire surface of the core of the carrier. The thickness of the cover layer is preferably from 0.10 μm to 0.80 μm, and more preferably from 0.10 μm to 0.50 μm. Since this thickness is less than the average particle diameter of the particulate electroconductive material, recessed portions can be formed on the surface of the cover layer.

When the thickness is less than 0.10 μm, the cover layer tends to be easily destroyed (i.e., the cover layer tends to be easily abraded). When the thickness is greater than 0.80 μm, a carrier adhesion problem in that particles of the carrier are adhered to an electrostatic latent image on a photoreceptor is often caused because the resinous cover layer is not a magnetic material. In addition, the resistance adjusting effect cannot be satisfactorily produced.

The thickness of the resinous cover layer can be determined by observing the cross section of the resinous cover layer on a carrier particle with a transmission electron microscope. In this regard, several resin portions (which do not include a particle of the electroconductive material) of the resinous cover layer are observed to measure the thickness of the several resin portions, and the thickness data are averaged to determine the thickness of the resinous cover layer.

Next, the core of the carrier will be described.

The carrier of this disclosure preferably satisfies the following relationship:

$$6.0 \leq B1/B2 \leq 8.0,$$

wherein B1 represents the BET specific surface area of the carrier, and B2 represents the BET specific surface area of the core.

In this case, since a rough surface can be formed on a core, which has high magnetic force but has a small number of recessed portions, a carrier having good toner bearing and feeding ability can be provided, and therefore formation of ghost images and halo images can be prevented.

The reason why formation of ghost images and halo images can be prevented when the above-mentioned relationship is satisfied is not yet determined. However, the reason is considered to be as follows. The surface area of a core particle depends on the size of the particle and the size of pores of the particle. If there are two core particles having the same particle diameter and different BET specific surface areas, a core particle having a smaller BET specific surface area has a smaller number of pores and has a higher bulk density than the other core particle.

However, since carrier particles having a resinous cover layer have a large surface area, the carrier particles have low bulk density. Therefore, in a developing process, the volume of the carrier (which has a greater magnetic force than toner) in the developer at a development nip between the surface of a developing sleeve and the surface of a photoreceptor increases even when the toner concentration is constant, and therefore the carrier can satisfactorily bear and feed the toner even when high speed development is performed.

When the ratio B1/B2 is less than 6.0, the effect of the particulate electroconductive material to reduce abrasion of the resinous cover layer is hardly produced, and thereby the cover layer is abraded after repeated use, resulting in decrease of the resistance of the carrier. In addition, since the bulk density of the carrier is relatively low and the magnetic force thereof is low, scattering of the carrier is often caused.

In contrast, when the ratio B1/B2 is greater than 8.0, the spent toner tends to be adhered to the resinous cover layer, thereby deteriorating the charging ability of the carrier, resulting in formation of uneven density images and formation of abnormal images such as ghost images and halo images.

The material of the core is not particularly limited as long as the material is a magnetic material. Specific examples of the materials include ferromagnetic metals such as iron and cobalt; iron oxides such as magnetite, hematite and ferrite; various metal alloys and compounds including such a ferromagnetic metal; and particulate resins in which such a ferromagnetic material is dispersed. Among these materials, Mn-based ferrites, Mn—Mg-based ferrites, Mn—Mg—Sr-based ferrites are preferable because of being environmentally friendly.

The BET specific surface area of the core can be adjusted by any known methods. For example, a method which is disclosed in JP-2000-172017-A and in which the calcination temperature of a core is adjusted, and a method which is disclosed in JP-2012-063718-A and in which the particle diameter of a pulverized magnetic core is adjusted can be used.

Next, properties of the carrier of this disclosure will be described.

The carrier preferably has a volume average particle diameter of from 32 μm to 40 μm. When the volume average particle diameter is less than 32 μm, the above-mentioned carrier adhesion problem in that the carrier adheres to an electrostatic latent image on a photoreceptor is often caused. When the volume average particle diameter is greater than 40 μm, reproducibility of fine images tends to deteriorate, thereby making it impossible to form high resolution images.

The volume average particle diameter can be measured, for example, by a particle diameter measuring instrument, MICROTRACK Model HRA9320-X100 from Nikkiso Co., Ltd.

The carrier of this disclosure preferably has a volume resistivity (logarithmic volume resistivity) of from 9 to 13 (Log Ω·cm) (i.e., $10^9$ to $10^{13}$ Ω·cm). When the volume resistivity is less than 9 (Log Ω·cm), a problem in that the carrier adheres to a non-image portion tends to be caused. When the volume resistivity is greater than 13 (Log Ω·cm), an image having an edge effect tends to be caused.

The volume resistivity of a carrier is measured using a cell illustrated in FIG. 1. Specifically, a carrier 3 is contained in a cell 2, which is made of a fluorine-containing resin and which has electrodes 1*a* and 1*b*, wherein each of the electrodes 1*a* and 1*b* has a surface of 2.5 cm×4 cm and the gap between the electrodes 1*a* and 1*b* is 0.2 cm. After the carrier 3 is fed into the cell 2 so as to overflow from the cell without applying a pressure to the carrier, the cell is tapped ten times from a height of 1 cm at a tapping speed of 30 times per minute, and a nonmagnetic flat blade is slid once along the upper surface of the cell to remove the portion of the carrier 3 projected from the upper surface of the cell 2. Next, a DC voltage of 1,000V is applied between the electrodes 1*a* and 1*b*, and the resistance r (Ω) of the carrier is measured with an instrument, HIGH RESISTANCE METER 4329A from Hewlett-Packard Japan, Ltd. The volume resistivity R (Ω·cm) of the carrier is calculated from the following equation (2):

$$R = r(2.5 \times 4)/0.2 \quad (2).$$

The logarithmic volume resistivity (log R(Ω·cm)) is obtained by taking logarithms of the volume resistivity R (Ω·cm).

Next, the developer of this disclosure will be described.

The carrier of this disclosure is mixed with a toner so as to be used as a two-component developer.

The toner includes a binder resin, and a colorant. The toner may be a monochrome toner or a color toner. In addition, the toner can include a release agent so as to be used for oil-less fixing systems. Such a toner tends to easily cause the toner filming problem, but the carrier of this disclosure can prevent occurrence of the toner filming problem even when such a toner is used. Therefore, the developer of this disclosure can produce high quality images over a long period of time.

In general, a color toner, particularly a yellow toner, easily causes a problem in that the color tone of the color toner is changed by a powder of the resinous cover layer of a carrier generated by abrasion of the cover layer. However, since the carrier of this disclosure hardly causes the problem, the carrier can be used in combination with a color toner without causing the problem.

The toner for use in the developer of this disclosure can be prepared by any known methods such as pulverization methods and polymerization methods. Specifically, pulverization methods include kneading toner components such as binder resins and colorants while heating the components to prepare a kneaded mixture; cooling the kneaded mixture to solidify the mixture; and pulverizing the solidified mixture, followed by classification to prepare toner particles. If desired, an external additive can be added to the toner particles to enhance the transferring property and the durability of the toner.

Specific examples of the kneader for use in kneading toner components include batch kneading machines such as two-roll mills, and BANBURY MIXER, and continuous kneaders such as twin screw extruders and single screw extruders. Specific examples of the twin screw extruders include KTK twin screw extruders from Kobe Steel, Ltd., TEM twin screw extruders from Toshiba Machine Co., Ltd., twin screw extruders from KCK Co., Ltd., PCM twin screw extruders from Ikegai Corp., KEX twin screw extruders from Kurimoto Ltd., etc. Specific examples of the continuous single screw extruders include KO-KNEADER from Buss AG.

In the pulverization process, it is preferable to crush the solidified toner component mixture using a crusher such as hammer mills, and cutter mills (e.g., ROTOPLEX from Hosokawa Micron Corp.), and then pulverizing the crushed toner component mixture using a pulverizer such as jet air pulverizers and mechanical pulverizers. In this regard, it is preferable to perform pulverization so that the resultant toner particles have an average particle diameter of from 3 μm to 15 μm.

It is preferable to use an air classifier for the classification process. In the classification process, the toner particles are classified so as to have an average particle diameter of from 5 μm to 20 μm.

The external additive adding process is performed using a mixer so that particles of an external additive are adhered to the surface of toner particles while disintegrated.

Specific examples of the resins for use as the binder resin of the toner include homopolymers of styrene and substituted styrene such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; acrylic resins such as polymethyl methacrylate and polybutyl methacrylate; and other resins such as polyvinyl chloride, polyvinyl acetate, polyethylene, polyester resins, polyurethane resins, epoxy resins, polyvinyl butyral resins, polyacrylic acid resins, rosin, modified rosins, terpene resins, phenolic resins, aliphatic or aromatic hydrocarbon resins, aromatic petroleum resins, etc. These resins are used alone or in combination.

Not only the heat-fixable resins mentioned above but also pressure-fixable resins can be used as the binder resin of the toner. Specific examples of the resins for use as the pressure-fixable binder resin include polyolefin (e.g., low molecular weight polyethylene and low molecular weight polypropylene); olefin copolymers (e.g., ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers, and ionomer resins); other resins such as epoxy resins, polyester resins, styrene-butadiene copolymers, polyvinyl pyrrolidone, methyl vinyl ether-maleic anhydride copolymers, maleic acid-modified phenolic resins, phenol-modified terpene resins, etc. These resins are used alone or in combination.

Any known pigments and dyes can be used as the colorant.

Specific examples of the yellow colorants include Cadmium Yellow, Mineral Fast Yellow, Nickel Titan Yellow, Naples Yellow, NEPHTHOL YELLOW S, HANZA YELLOW G, HANZA YELLOW 10G, BENZIDINE YELLOW GR, Quinoline Yellow Lake, PERMANENT YELLOW NCG, Tartrazine Lake, etc.

Specific examples of the orange colorants include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red colorants include red iron oxide, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet colorants include Fast Violet B, and Methyl Violet Lake, etc.

Specific examples of the blue colorants include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green colorants include Chrome Green, chromium oxide, Pigment Green B, Malachite Green Lake, etc.

Specific examples of the black colorants include carbon black, oil furnace black, channel black, lamp black, acetylene black, azine dyes such as aniline black, metal salts of azo dyes, metal oxides, complex metal oxides, etc.

These pigments and dyes can be used alone or in combination.

The release agent to be optionally included in the toner is not particularly limited. Specific examples of such a release agent include polyolefins such as polyethylene and polypropylene; fatty acid metal salts, fatty acid esters, paraffin waxes, amide waxes, polyalcohol waxes, silicone varnishes, carnauba waxes, ester waxes, etc., but are not limited thereto. These release agents can be used alone or in combination.

The toner can include a charge controlling agent. The charge controlling agent is not particularly limited, and Nigrosine, azine dyes having an alkyl group having 2 to 16 carbon atoms (disclosed in JP-S42-001627-B), basic dyes, lake pigments of basic dyes, quaternary ammonium salts, dialkyltin compounds, dialkyltin borate compounds, guanidine derivatives, polyamine resins, metal complexes of monoazo dyes, metal complexes of acids such as salicylic acid derivatives, sulfonated copper phthalocyanine pigments, organic boron salts, fluorine-containing quaternary ammonium salts, calixarene compounds, etc., can be used. These compounds can be used alone or in combination.

Specific examples of the basic dyes include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000), and lake pigments of these basic dyes.

Specific examples of the quaternary ammonium salts include C.I. Solvent Black 8 (C.I. 26150), benzoylmethylhexadecylammonium chloride, and decyltrimethylammonium chloride.

Specific examples of the dialkyltin compounds include dibutyltin compounds, and dioctyltin compounds.

Specific examples of the polyamine resins include vinyl polymers having an amino group, and condensation polymers having an amino group.

Specific examples of the metal complexes of monoazo dyes include metal complexes of monoazo dyes disclosed in JP-S41-20153-B, JP-S43-27596-B, JP-S44-6397-B and JP-S45-26478-B.

Specific examples of the metal complexes of acids include metal (e.g., Zn, Al, Co, Cr and Fe) complexes of salicylic acid, salicylic acid derivatives (e.g., compounds disclosed in JP-S55-42752-B and JP-S59-7385-B), dialkylsalicylic acids, naphthoic acid, and dicarboxylic acids.

Among these charge controlling agents, metal complexes of salicylic acid derivatives having a white color are preferably used for color toners (excluding black toners).

The external additive is not particularly limited, and any known materials for use as external additives of toner can be used. Specific examples thereof include particulate inorganic materials (such as silica, titanium oxide, alumina, silicon carbide, silicon nitride and boron nitride), particulate resins, etc. Specific examples of such particulate resins include particulate polymers (such as polymethyl methacrylate and polystyrene), which are prepared by a soap-free emulsion polymerization method and which have an average particle diameter of from 0.05 μm to 1 μm. These materials can be used alone or in combination.

It is preferable for such inorganic materials to be hydrophobized.

Among these materials, metal oxides such as silica and titanium oxide, whose surface is hydrophobized, are preferable. It is more preferable to use a combination of a hydrophobized silica and a hydrophobized titanium oxide, wherein the added amount of hydrophobized titanium oxide is greater than that of the hydrophobized silica, so that the resultant toner can maintain good charge stability even when environmental humidity changes.

The combination of the carrier of this disclosure with a toner can be used for a supplementary developer. By using such a supplementary developer for an image forming apparatus in which a supplementary developer is supplied to a developing device while discharging excess developer from the developing device, the image forming apparatus can stably produce high quality images over a long period of time.

In this case, degraded carrier particles in the developing device are discharged to be replaced with fresh carrier particles included in the supplementary developer, and therefore the carrier in the developing device can maintain good charging ability over a long period of time, thereby making it possible to stably form high quality images.

This image forming method is particularly preferable for forming images having a high image area proportion. When images having a high image area proportion are formed, the spent toner problem is often caused and thereby the carrier is degraded. However, by using this image forming method, high quality images can be stably produced over a long period of time. This is because when images having a high image area proportion are formed, the amount of the supplementary developer supplied increases, and therefore a large amount of degraded carrier particles in the developing device are replaced with fresh carrier particles included in the supplementary developer supplied.

The supplementary developer preferably includes a toner in an amount of from 2 to 50 parts by weight per 1 part by weight of the carrier of this disclosure. When the amount of toner is less than 2 parts by weight, too large an amount of carrier particles are supplied to a developing device, thereby excessively increasing the content of the carrier in the developer in the developing device. In this case, the developer has too high a charge quantity, thereby deteriorating the developing ability of the developer, resulting in formation of low density images. In contrast, when the amount of toner is greater than 50 parts by weight, the content of the carrier in the supplementary developer decreases, and therefore replacement of degraded carrier particles with fresh carrier particles is not satisfactorily performed, thereby hardly producing the effect of preventing the carrier from deteriorating.

Next, the image forming method of this disclosure will be described. The image forming method of this disclosure includes at least an electrostatic latent image forming process in which an electrostatic latent image is formed on an image bearing member; a developing process in which the electrostatic latent image is developed with the two-component developer of this disclosure to form a toner image on the image bearing member; a transferring process in which the toner image is transferred onto a recording medium; and a fixing process in which the toner image on the recording medium is fixed to the recording medium.

Next, the process cartridge of this disclosure will be described.

Figure 2:
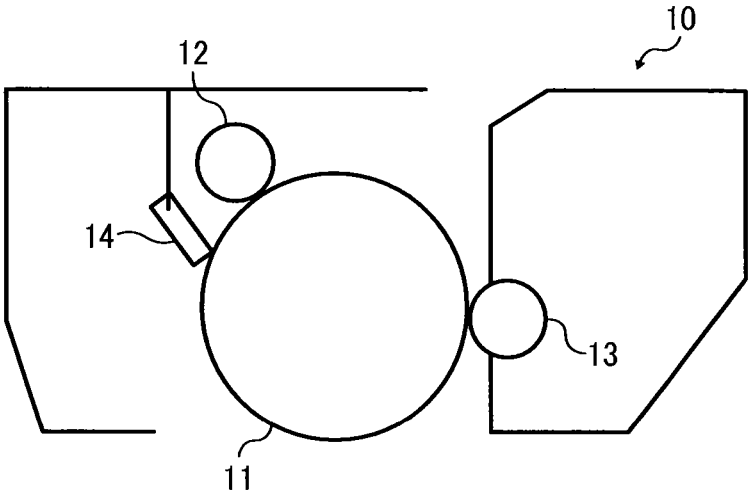
FIG. 2 is a schematic view illustrating a process cartridge according to an embodiment.

FIG. 2 illustrates an example of the process cartridge of this disclosure. Referring to FIG. 2, a process cartridge 10 includes a photoreceptor 11, a charger 12 to charge the photoreceptor, a developing device 13 to develop an electrostatic latent image formed on the photoreceptor 11 with the two-component developer of this disclosure to form a toner image on the photoreceptor, and a cleaner 14 to remove residual toner from the surface of the photoreceptor 11 after the toner image is transferred. These devices are integrated as a unit, and the process cartridge is detachably attachable to the main body of an image forming apparatus such as copiers and printers.

The image forming method of an image forming apparatus to which the process cartridge is attached will be described.

Initially, the photoreceptor 11 is rotated at a predetermined peripheral speed. The charger 12 evenly charges the peripheral surface of the photoreceptor 11 so that the photoreceptor has a predetermined positive or negative potential. Next, the charged photoreceptor 11 is scanned with a laser beam, which is emitted by an irradiator and which is modulated by image information, to form an electrostatic latent image on the surface of the photoreceptor. The developing device 13 develops the electrostatic latent image with the developer of this disclosure to form a toner image on the photoreceptor 11. The toner image on the photoreceptor 11 is then transferred onto a recording medium, which is timely fed from a recording medium feeding section (not shown) to a transfer position. The recording medium bearing the toner image thereon is fed to a fixing device (not shown) of the image forming apparatus to which the process cartridge is attached to fix the toner image on the recording medium, resulting in formation of a print. The print is output from the image forming apparatus. The surface of the photoreceptor 11 is cleaned by the cleaner 14, and the photoreceptor is then discharged by a discharger (not shown) so that the photoreceptor is ready for the next image formation.

The image forming apparatus of this disclosure will be described by reference to FIG. 3.

Figure 3:
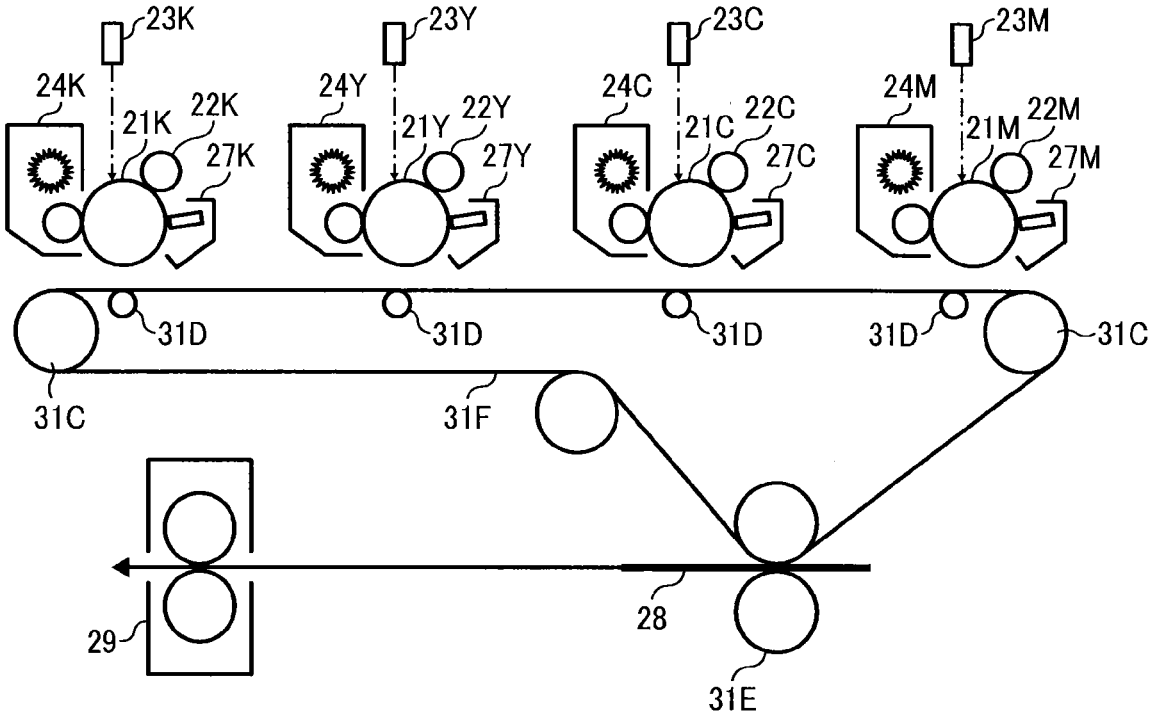
FIG. 3 is a schematic view illustrating an image forming apparatus according to an embodiment.

FIG. 3 illustrates a full color image forming apparatus, which is an example of the image forming apparatus of this disclosure.

The image forming apparatus includes four image forming sections to form magenta (M), cyan (C), yellow (Y) and black (K) color toner images on respective photoreceptors 21M, 21C, 21Y and 21K; a transferring device including an intermediate transfer belt 31F, primary transfer rollers 31D to transfer the color toner images from the photoreceptors 21 to the intermediate transfer belt 31F, and a secondary transfer roller 31E to transfer the color toner images from the intermediate transfer belt 31F to a recording medium 28; a fixing device 29 to fix the color toner images to the recording medium, resulting in formation of a full color image.

Each of the image forming sections include the photoreceptor 21M, 21C, 21Y or 21K, which serves as an image bearing member; a charger 22M, 22C, 22Y or 22K to charge a surface of the photoreceptor; an irradiator 23M, 23C, 23Y or 23K to irradiate the charged photoreceptor with light to form an electrostatic latent image on the photoreceptor; a developing device 24M, 24C, 24Y or 24K to develop the electrostatic latent image with a color toner to form a M, C, Y or K toner image on the photoreceptor; and a cleaner 27M, 27C, 27Y or 27K to clean the surface of the photoreceptor after the toner image is transferred.

In the image forming apparatus illustrated in FIG. 3, color toner images formed on the photoreceptors 21Y, 21M, 21C and 21K are sequentially transferred onto the intermediate transfer belt 31F, which is rotated by rollers 31C serving as a driving device while tightly stretched thereby, to form a combined color toner image on the intermediate transfer belt.

The combined color toner image, which is fed by the intermediate transfer belt 31F, is secondarily transferred onto the recording medium 28 at the secondary transfer nip in which the intermediate transfer belt is opposed to the secondary transfer roller 31E. The recording medium 28 bearing the combined color toner image thereon is fed to the fixing device 29 so that the combined color toner image is fixed to the recording medium, resulting in formation of a full color image.

The image forming apparatus of this disclosure includes at least an image bearing member; a charger to charge a surface of the image bearing member; an irradiator to irradiate the charged image bearing member with light modulated by image information to form an electrostatic latent image on the image bearing member; a developing device to develop the electrostatic latent image with the two-component developer of this disclosure to form a toner image on the image bearing member; a transferring device to transfer the toner image onto a recording medium; and a fixing device to fix the toner image on the recording medium. The image forming apparatus optionally includes other devices such as a discharger to discharge the image bearing member after the toner image is transferred; a cleaner to clean the surface of the image bearing member after the toner image is transferred; a recycling device to recycle the toner collected by the cleaner; and a controller to control the devices of the image forming apparatus.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Core Preparation Example 1

Initially, 650 parts of $MnCO_3$, 150 parts of $Mg(OH)_2$, 500 parts of $Fe_2O_3$ and 6 parts of $SrCO_3$ were mixed to prepare a powder mixture.

The powder mixture was calcined for 1 hour at 800° C. in the atmosphere. The calcined material was cooled and pulverized to prepare a powder having a particle diameter of not greater than 3 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 4 hours at 1120° C. in a nitrogen atmosphere.

The calcined material was disintegrated by a disintegrator, followed by filtering to prepare a spherical ferrite C1, which has a volume average particle diameter of about 35 μm, and a BET specific surface area of 0.13 $m^2/g$.

The volume average particle diameter was measured using a particle diameter measuring instrument, MICROTRACK Model HRA9320-X100 from Nikkiso Co., Ltd., under the following conditions.

Solvent (dispersing medium): water

Preset refractive index of the ferrite: 2.42

Preset refractive index of the solvent: 1.33

Preset concentration: about 0.06

The BET specific surface area was measured by a micromeritics automatic surface area and porosimetry analyzer, TRISTAR 3000 from Shimadzu Corporation. Specifically, about 5 grams of the sample (ferrite) was weighed and fed into a sample cell, and then subjected to vacuum drying for 24 hours using a pretreatment smart prep from Shimadzu Corporation to remove foreign materials and moisture on the surface of the sample. The pre-treated sample was set in TRISTAR 3000 to obtain a relationship between the nitrogen gas adsorption amount and the relative pressure. The BET specific surface area of the sample was determined using the relationship and a BET multipoint method.

Core Preparation Example 2

The procedure for preparation of the ferrite C1 was repeated except that the calcination temperature was changed from 800° C. to 850° C. to prepare a spherical ferrite C2. It was confirmed that the ferrite C2 has a volume average particle diameter of about 35 μm, and a BET specific surface area of 0.16 $m^2/g$.

Core Preparation Example 3

The procedure for preparation of the ferrite C1 was repeated except that the calcination temperature was changed from 800° C. to 900° C. to prepare a spherical ferrite C3. It was confirmed that the ferrite C3 has a volume average particle diameter of about 35 μm, and a BET specific surface area of 0.20 $m^2/g$.

Core Preparation Example 4

The procedure for preparation of the ferrite C1 was repeated except that the calcination temperature was changed from 800° C. to 750° C. to prepare a spherical ferrite C4. It was confirmed that the ferrite C4 has a volume average particle diameter of about 35 μm, and a BET specific surface area of 0.12 $m^2/g$.

Core Preparation Example 5

The procedure for preparation of the ferrite C1 was repeated except that the calcination temperature was changed from 800° C. to 950° C. to prepare a spherical ferrite C5. It was confirmed that the ferrite C5 has a volume average particle diameter of about 35 μm, and a BET specific surface area of 0.21 $m^2/g$.

Particulate Electroconductive Material Preparation Example 1

Initially, 100 g of an aluminum oxide (AKP-30 from Sumitomo Chemical Co., Ltd. was dispersed in 1 liter of water to prepare a suspension, and the suspension was heated to 70° C. Next, a solution prepared by dissolving 85 g of stannic chloride, and 3.8 g of phosphorus pentaoxide in 1.7 liters of 2N hydrochloric acid, and 12% by weight ammonia water were dropped into the suspension over one hour and forty minutes so that the pH of the suspension falls in a range of from 7 to 8.

The suspension was then filtered and the resultant cake was washed, followed by drying at 110° C. The thus obtained powder was heated for 1 hour at 500° C. in a nitrogen atmosphere. Thus, a particulate electroconductive material P1, which has an average particle diameter of 0.35 μm and a powder specific resistance of 8 Ω·cm, was prepared.

The average particle diameter was measured using an instrument, NANOTRACK UPA-EX-150 from Nikkiso Co., Ltd. under the following conditions.

Solvent used: water

Preset refractive index of the electroconductive material: 1.66

Preset refractive index of the solvent: 1.33

The powder specific resistance was measured by a method in which the electroconductive material is pelletized at a pressure of 230 $Kg/cm^2$, the electric resistance of the pellet is measured by a LCR meter from Hewlett Packard Japan, Ltd., and the electric resistance is converted to a specific resistance.

Resin Synthesis Example 1

Three hundreds (300) grams of toluene was fed into a flask equipped with an agitator, and was heated to 90° C. under a nitrogen gas flow. Next, a mixture of 84.4 g (200 mmol) of 3-methacryloxypropyltris(trimethylsiloxy)silane ($CH_2{=}C(CH_3)—COO—C_3H_6—Si(OSi(CH_3)_3)_3$, SILAPLANE TM-0701T from CHISSO CORPORATION), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was dropped into the flask over one hour.

After dropping the mixture, a solution prepared by dissolving 0.06 g (0.3 mmol) of 2,2'-azobis-2-methylbutyronitrile in 15 g of toluene was fed into the flask (i.e., the total added amount of 2,2'-azobis-2-methylbutyronitrile is 0.64 g (3.3 mmol)), and the mixture was agitated for 3 hours at a temperature of from 90 to 100° C. to perform radical copolymerization. Thus, a methacrylic copolymer R1 was prepared.

Example 1

Carrier Preparation Example 1

1. Preparation of Carrier Cover Layer

The following components were mixed for 10 minutes using a HOMOMIXER mixer to prepare a cover layer coating liquid.

| | |
|---|---|
| Methacrylic Copolymer R1 prepared above (solid content of 50% by weight) | 51.3 parts |
| Guanamine solution (solid content of 70% by weight) | 14.6 parts |
| Titanium-containing catalyst (TC-750 from Matsumoto Fine Chemical Co., Ltd., solid content of 60% by weight) | 4 parts |
| Silicone resin solution (SR2410 from Dow Corning Toray Silicone Co., Ltd., solid content of 20% by weight) | 648 parts |
| Aminosilane (SH6020 from Dow Corning Toray Silicone Co., Ltd., solid content of 100% by weight) | 3.2 parts |
| Particulate electroconductive material P1 prepared above | 80 parts |
| Toluene | 1000 parts |

The thus prepared covering layer coating liquid was applied to 5,000 parts of the above-prepared core (i.e., the spherical ferrite C1) and then dried using a coater, SPIRA COTA from Okada Seiko Co., Ltd., in which the inner temperature is controlled at 55° C. Thus, a ferrite powder having a resinous cover layer with a thickness of 0.30 μm was prepared.

The ferrite powder was then subjected to a heat treatment for 1 hour at 200° C.

After being cooled, the aggregated ferrite powder was disintegrated using a sieve with openings of 63 μm. Thus, a carrier 1, which has a BET specific surface area of 0.8 $m^2/g$, a volume average particle diameter of 36 μm, and a volume resistivity of 13 Log Ω·cm, was prepared.

The BET specific surface area of the carrier was measured with a micromeritics automatic surface area and porosimetry analyzer, TRISTAR 3000 from Shimadzu Corporation.

Specifically, about 5 grams of the sample (carrier) was weighed and fed into a sample cell, and then subjected to vacuum drying for 24 hours using a pretreatment smart prep from Shimadzu Corporation to remove foreign materials and moisture from the surface of the sample. The pre-treated sample was set in TRISTAR 3000 to obtain a relationship between the nitrogen gas adsorption amount and the relative pressure. The BET specific surface area of the sample was determined using the relationship and a BET multipoint method.

The volume average particle diameter was measured using a particle diameter measuring instrument, MICROTRACK Model HRA9320-X100 from Nikkiso Co., Ltd., under the following conditions.

Solvent (dispersing medium): water

Preset refractive index of the ferrite: 2.42

Preset refractive index of the solvent: 1.33

Preset concentration: about 0.06

The volume resistivity of the carrier was measured using a cell illustrated in FIG. 1. Specifically, the carrier was contained in the cell 2, which is made of a fluorine-containing resin and which has the electrodes 1*a* and 1*b*, wherein each of the electrodes has a surface of 2.5 cm×4 cm and the gap between the electrodes is 0.2 cm. After the carrier was fed into the cell 2 so as to overflow from the cell without applying a pressure to the carrier, the cell was tapped ten times from a height of 1 cm at a tapping speed of 30 times per minute, and a nonmagnetic flat blade was slid once along the upper surface of the cell to remove the portion of the carrier projected from the upper surface of the cell. Next, a DC voltage of 1,000V was applied between the electrodes 1*a* and 1*b*, and the resistance r (C2) of the carrier was measured with an instrument, HIGH RESISTANCE METER 4329A from Hewlett-Packard Japan, Ltd. The volume resistivity R (Ω·cm) of the carrier was calculated from the following equation (2):

$$R=r(2.5\times4)/0.2 \quad (2).$$

The logarithmic volume resistivity (log R(Ω·cm)) was obtained by taking logarithms of the volume resistivity R (Ω·cm).

Example 2

Carrier Preparation Example 2

The procedure for preparation of the carrier 1 was repeated except that the added amount of the particulate electroconductive material P1 was changed from 80 parts to 200 parts. Thus, a carrier 2, which has a BET specific surface area of 0.9 $m^2/g$, a volume average particle diameter of 36 μm, and a volume resistivity of 10 Log cm, was prepared.

Example 3

Carrier Preparation Example 3

The procedure for preparation of the carrier 1 was repeated except that the spherical ferrite C1 was replaced with the spherical ferrite C2. Thus, a carrier 3, which has a BET specific surface area of 1.1 $m^2/g$, a volume average particle diameter of 36 μm, and a volume resistivity of 13 Log Ω·cm, was prepared.

Example 4

Carrier Preparation Example 4

The procedure for preparation of the carrier 3 was repeated except that the added amount of the particulate electroconductive material P1 was changed from 80 parts to 140 parts. Thus, a carrier 4, which has a BET specific surface area of 1.2 $m^2/g$, a volume average particle diameter of 36 μm, and a volume resistivity of 12 Log Ω·cm, was prepared.

Example 5

Carrier Preparation Example 5

The procedure for preparation of the carrier 3 was repeated except that the added amount of the particulate electroconductive material P1 was changed from 80 parts to 200 parts. Thus, a carrier 5, which has a BET specific surface area of 1.3 $m^2/g$, a volume average particle diameter of 36 μm, and a volume resistivity of 10 Log Ω·cm, was prepared.

Example 6

Carrier Preparation Example 6

The procedure for preparation of the carrier 1 was repeated except that the spherical ferrite C1 was replaced with the spherical ferrite C3. Thus, a carrier 6, which has a BET specific surface area of 1.5 $m^2/g$, a volume average particle diameter of 36 μm, and a volume resistivity of 13 Log Ω·cm, was prepared.

Example 7

Carrier Preparation Example 7

The procedure for preparation of the carrier 2 was repeated except that the spherical ferrite C1 was replaced with the spherical ferrite C3. Thus, a carrier 7, which has a BET specific surface area of 1.6 $m^2/g$, a volume average particle diameter of 36 μm, and a volume resistivity of 10 Log Ω·cm, was prepared.

Example 8

Carrier Preparation Example 8

The procedure for preparation of the carrier 3 was repeated except that the added amount of the particulate electroconductive material P1 was changed from 80 parts to 75 parts. Thus, a carrier 8, which has a BET specific surface area of 1.1 $m^2/g$, a volume average particle diameter of 36 μm, and a volume resistivity of 13 Log Ω·cm, was prepared.

Example 9

Carrier Preparation Example 9

The procedure for preparation of the carrier 3 was repeated except that the added amount of the particulate electroconductive material P1 was changed from 80 parts to 210 parts. Thus, a carrier 9, which has a BET specific surface area of 1.3 $m^2/g$, a volume average particle diameter of 36 μm, and a volume resistivity of 10 Log Ω·cm, was prepared.

Example 10

Carrier Preparation Example 10

The procedure for preparation of the carrier 1 was repeated except that the spherical ferrite C1 was replaced with the spherical ferrite C4, and the added amount of the particulate electroconductive material P1 was changed from 80 parts to 85 parts. Thus, a carrier 10, which has a BET specific surface area of 0.8 $m^2/g$, a volume average particle diameter of 36 μm, and a volume resistivity of 13 Log Ω·cm, was prepared.

Example 11

Carrier Preparation Example 11

The procedure for preparation of the carrier 1 was repeated except that the spherical ferrite C1 was replaced with the spherical ferrite C5, and the added amount of the particulate electroconductive material P1 was changed from 80 parts to 175 parts. Thus, a carrier 11, which has a BET specific surface area of 1.6 $m^2/g$, a volume average particle diameter of 36 μm, and a volume resistivity of 11 Log Ω·cm, was prepared.

Comparative Example 1

Carrier Preparation Comparative Example 1

The procedure for preparation of the carrier 1 was repeated except that the added amount of the particulate electroconductive material P1 was changed from 80 parts to 75 parts. Thus, a comparative carrier 1', which has a BET specific surface area of 0.7 $m^2/g$, a volume average particle diameter of 36 μm, and a volume resistivity of 13 Log Ω·cm, was prepared.

Comparative Example 2

Carrier Preparation Comparative Example 2

The procedure for preparation of the carrier 6 was repeated except that the added amount of the particulate electroconductive material P1 was changed from 80 parts to 210 parts. Thus, a comparative carrier 2', which has a BET specific surface area of 1.7 $m^2/g$, a volume average particle diameter of 36 μm, and a volume resistivity of 10 Log Ω·cm, was prepared.

Comparative Example 3

Carrier Preparation Comparative Example 3

The procedure for preparation of the carrier 10 was repeated except that the added amount of the particulate electroconductive material P1 was changed from 85 parts to 80 parts. Thus, a comparative carrier 3', which has a BET specific surface area of 0.7 $m^2/g$, a volume average particle diameter of 36 μm, and a volume resistivity of 13 Log Ω·cm, was prepared.

Comparative Example 4

Carrier Preparation Comparative Example 4

The procedure for preparation of the carrier 11 was repeated except that the added amount of the particulate electroconductive material P1 was changed from 175 parts to 160 parts. Thus, a comparative carrier 4', which has a BET specific surface area of 1.7 $m^2/g$, a volume average particle diameter of 36 μm, and a volume resistivity of 10 Log Ω·cm, was prepared.

The properties of the carriers 1-11 and the comparative carriers 1'-4' are shown in Table 1 below.

TABLE 1

| | Carrier | Core | BET specific surface area (B2) of core ($m^2/g$) | Added amount of particulate electro-conductive material (parts by weight) | BET specific surface area (B1) of carrier ($m^2/g$) | B1/B2 |
|---|---|---|---|---|---|---|
| Ex. 1 | 1 | C1 | 0.13 | 0.016 | 0.8 | 6.0 |
| Ex. 2 | 2 | C1 | 0.13 | 0.040 | 0.9 | 7.2 |
| Ex. 3 | 3 | C2 | 0.16 | 0.016 | 1.1 | 6.9 |

TABLE 1-continued

| | Carrier | Core | BET specific surface area (B2) of core ($m^2/g$) | Added amount of particulate electro-conductive material (parts by weight) | BET specific surface area (B1) of carrier ($m^2/g$) | B1/B2 |
|---|---|---|---|---|---|---|
| Ex. 4 | 4 | C2 | 0.16 | 0.028 | 1.2 | 7.5 |
| Ex. 5 | 5 | C2 | 0.16 | 0.040 | 1.3 | 7.8 |
| Ex. 6 | 6 | C3 | 0.20 | 0.016 | 1.5 | 7.5 |
| Ex. 7 | 7 | C3 | 0.20 | 0.040 | 1.6 | 8.0 |
| Ex. 8 | 8 | C2 | 0.16 | 0.015 | 1.1 | 6.6 |
| Ex. 9 | 9 | C2 | 0.16 | 0.042 | 1.3 | 8.0 |
| Ex. 10 | 10 | C4 | 0.12 | 0.017 | 0.8 | 6.7 |
| Ex. 11 | 11 | C5 | 0.21 | 0.035 | 1.6 | 7.6 |
| Comp. Ex. 1 | 1' | C1 | 0.13 | 0.015 | 0.7 | 5.6 |
| Comp. Ex. 2 | 2' | C3 | 0.20 | 0.042 | 1.7 | 8.5 |
| Comp. Ex. 3 | 3' | C4 | 0.12 | 0.016 | 0.7 | 5.8 |
| Comp. Ex. 4 | 4' | C5 | 0.21 | 0.040 | 1.7 | 8.2 |

Toner Preparation Example

1. Synthesis of Polyester Resin A

The following components were fed into a reaction vessel equipped with a thermometer, an agitator, a condenser and a nitrogen feed pipe.

| | |
|---|---|
| Propylene oxide adduct of bisphenol A (hydroxyl value of 320 mgKOH/g) | 443 parts |
| Diethylene glycol | 135 parts |
| Terephthalic acid | 422 parts |
| Dibutyltin oxide | 2.5 parts |

The components were reacted at 200° C. until the reaction product had an acid value of 10 mgKOH/g to prepare a polyester resin A, which has a glass transition temperature (Tg) of 63° C. and a number average molecular weight of 6,000.

2. Synthesis of Polyester Resin B

The following components were fed into a reaction vessel equipped with a thermometer, an agitator, a condenser and a nitrogen feed pipe.

| | |
|---|---|
| Propylene oxide adduct of bisphenol A (hydroxyl value of 320 mgKOH/g) | 443 parts |
| Diethylene glycol | 135 parts |
| Terephthalic acid | 422 parts |
| Dibutyltin oxide | 2.5 parts |

The components were reacted at 230° C. until the reaction product had an acid value of 7 mgKOH/g to prepare a polyester resin B, which has a glass transition temperature (Tg) of 65° C. and a number average molecular weight of 16,000.

3. Preparation of Mother Toner 1

The following components were mixed for 3 minutes using a HENSCHEL MIXER mixer (HENSCHEL 20B from Mitsui Mining Co., Ltd.), which was rotated at 1,500 rpm.

| | |
|---|---|
| Polyester resin A prepared above | 40 parts |
| Polyester resin B prepared above | 60 parts |
| Carnauba wax | 1 part |
| Carbon black | 15 parts |

(#44 from Mitsubishi Chemical Corp.)

The mixture was kneaded using a single screw extruder, KO-KNEADER from Buss AG under the following conditions.

Preset temperature: 100° C. (entrance), 50° C. (exit)

Supply of material to be kneaded: 2 kg/hour

Thus, a basic toner A1 was prepared.

After being cooled, the basic toner A1 was pulverized by a pulverizer, and then subjected to a fine pulverization treatment using an I-type mill (IDS-2 from Nippon Pneumatic Mfg. Co., Ltd.) having a flat collision plate. The conditions of the fine pulverization treatment were as follows.

Air pressure: 6.8 atm/cm$^2$

Supply of material to be pulverized: 0.5 kg/hour

The pulverized basic toner A1 was classified using a classifier (132 MP from Alpine AG). Thus, a mother toner 1 was prepared.

4. Preparation of Toner 1

Addition of External Additive

One hundred (100) parts of the mother toner 1 was mixed with 1.0 part of a hydrophobized silica R972 from Nippon Aerosil Co. (Evonik Industries), which serves as an external additive, using a HENSCHEL MIXER mixer to prepare a toner 1, which has a particle diameter of 7.2 μm.

Developer Preparation Examples 1-11 and Comparative Examples 1'-4'

Ninety three (93) parts of each of the carriers 1-11 and the comparative carriers 1'-4' was mixed with 7.0 parts of the above-prepared toner 1 for 20 minutes using a ball mill to prepare developers 1-11 and comparative developers 1'-4'.

Each of the developers 1-11 and the comparative developers 1'-4' was evaluated with respect to the following properties.

1. Change in Charge Quantity and Volume Resistivity

The developer was set in a digital color image forming apparatus, RICOH PRO C901 from Ricoh Co., Ltd., and a running test in which 1,000,000 copies of an original with an image area proportion of 20% are produced was performed. Before and after the running test, the charge quantity (Q) and the logarithmic volume resistivity (Log R) of the carrier of the developer were measured to determine change in charge quantity (Q1−Q2) and change in logarithmic volume resistivity (Log R1−Log R2) of the carrier, wherein Q1 and Log R1 represent the charge quantity and the logarithmic volume resistivity of the carrier before the running test, and Q2 and Log R2 represent the charge quantity and the logarithmic volume resistivity of the carrier after the running test.

The method for measuring the charge quantity of the carrier was as follows.

Specifically, the initial developer, which includes the carrier and the toner in a weight ratio of 93:7 and which had been agitated so as to be frictionally charged, was subjected to blow-off treatment using a blow-off device TB200 from Toshiba Chemical (KYOCERA Chemical) to determine the charge quantity (Q1) of the carrier. In addition, after the running test, the charge quantity of the carrier of the developer was also measured by the blow-off method to determine the charge quantity (Q2) of the carrier.

The change in charge quantity (Q1−Q2) is preferably not greater than 10 μC/g.

The method for measuring the logarithmic volume resistivity (Log R) of the carrier is the method mentioned above. Specifically, the logarithmic volume resistivity of each of the carrier of the initial developer and the carrier of the developer used for the running test, which were obtained by the blow-off device, was measured by the method mentioned above.

The change in logarithmic volume resistivity (Log R1−Log R2) is preferably not greater than 2.0.

The evaluation results are shown in Table 2.

TABLE 2

| | Developer | Q1 (−μc/g) | Q2 (−μC/g) | Q1 − Q2 (−μC/g) | Log R1 (log (Ω · cm)) | Log R2 (log (Ω · cm)) | Log R1 − Log R2 |
|---|---|---|---|---|---|---|---|
| Ex. 1 | 1 | 36 | 33 | 3 | 13.0 | 11.0 | 2.0 |
| Ex. 2 | 2 | 37 | 30 | 7 | 10.0 | 12.0 | −2.0 |
| Ex. 3 | 3 | 36 | 33 | 3 | 13.0 | 11.0 | 2.0 |
| Ex. 4 | 4 | 35 | 34 | 1 | 12.0 | 12.0 | 0.0 |
| Ex. 5 | 5 | 36 | 30 | 6 | 10.0 | 12.0 | −2.0 |
| Ex. 6 | 6 | 40 | 36 | 4 | 13.0 | 11.0 | 2.0 |
| Ex. 7 | 7 | 37 | 31 | 6 | 10.0 | 12.0 | −2.0 |
| Ex. 8 | 8 | 36 | 31 | 5 | 13.0 | 10.0 | 3.0 |
| Ex. 9 | 9 | 40 | 32 | 8 | 10.0 | 13.0 | −3.0 |
| Ex. 10 | 10 | 36 | 32 | 4 | 13.0 | 11.0 | 2.0 |
| Ex. 11 | 11 | 39 | 33 | 6 | 11.0 | 13.0 | −2.0 |
| Comp. Ex. 1 | 1' | 35 | 26 | 9 | 13.0 | 9.0 | 4.0 |
| Comp. Ex. 2 | 2' | 36 | 25 | 11 | 10.0 | 13.0 | −3.0 |
| Comp. Ex. 3 | 3' | 38 | 30 | 8 | 13.0 | 10.0 | 3.0 |
| Comp. Ex. 4 | 4' | 38 | 27 | 11 | 10.0 | 13.0 | −3.0 |

2. Image Quality

Each developer was set in the digital color image forming apparatus, RICOH PRO C901 from Ricoh Co., Ltd., and image formation was performed under the following conditions.

Development gap: 0.3 mm (i.e., gap between surface of photoreceptor and surface of developing sleeve)

Doctor gap: 0.65 mm (i.e., gap between surface of developing sleeve and tip of doctor)

Linear speed of photoreceptor: 440 mm/sec

Linear speed of developing sleeve/linear speed of photoreceptor: 1.80

Image writing density: 600 dpi (dot per inch)

Potential (Vd) of charged photoreceptor: −600V

Potential of electrostatic solid image: −100V

Development bias: DC (−500V)/AC component (2 KHz, −100V to −900V, and duty of 50%)

2-(1) Image Density of Solid Image

The image density of a solid image with a size of 30 mm×30 mm was determined by measuring image densities of five points of the center of the solid image with a spectrodensitometer X-RITE 938 from X-Rite Inc. and averaging the five image density data. In this regard, since the potential of the electrostatic latent image of the solid image was −100V and the DC voltage of the development bias was −500V, the development potential was 400V (i.e., −100V−(−500V)).

The difference between the image density of the first image and the image density of the 1,000,000$^{th}$ image was determined. The image density property of the developer is graded as follows.

◎: The image density difference is less than 0.2. (Excellent)

○: The image density difference is not less than 0.2 and less than 0.3. (Good)

Δ: The image density difference is not less than 0.3 and less than 0.4. (Usable)

X: The image density difference is not less than 0.4. (Unusable)

2-(2) Image Density of Highlight Portion (Highlight Image Density)

The image density of a highlight portion with a size of 30 mm×30 mm was determined by measuring image densities of five points of the center of the highlight portion with the spectrodensitometer X-RITE 938 and averaging the five image density data. In this regard, since the potential of the electrostatic latent image of the highlight portion was −350V and the DC voltage of the development bias was −500V, the development potential was 150V (i.e., −350V−(−500V)).

The difference between the highlight image density of the first image and the highlight image density of the 1,000,000$^{th}$ image was determined. The highlight image density property of the developer is graded as follows.

◎: The highlight image density difference is less than 0.2. (Excellent)

○: The highlight image density difference is not less than 0.2 and less than 0.3. (Good)

Δ: The highlight image density difference is not less than 0.3 and less than 0.4. (Usable)

X: The highlight image density difference is not less than 0.4. (Unusable)

2-(3) Granularity of Image

After the 1,000,000-copy running test, the granularity of an image having lightness of from 50% to 80% was measured. In this regard, the granularity of image is defined by the following equation.

$$\text{Granularity}=\exp(aL+b)\int(WS(f))^{1/2}\cdot VTF(f)df,$$

wherein L represents the average lightness, f represents the spatial frequency (cycle/mm), WS(f) represents the power spectrum of lightness variation, VTF(f) represents the visual spatial frequency characteristic, and each of a and b is a coefficient. The granularity property of the developer is graded as follows.

◎: The granularity is less than 0.2. (Excellent)

○: The granularity is not less than 0.2 and less than 0.3. (Good)

Δ: The granularity is not less than 0.3 and less than 0.4. (Usable)

X: The granularity is not less than 0.4. (Unusable)

2-(4) Adhesion of Carrier to Solid Image

When carrier particles are adhered to the photoreceptor, the photoreceptor and the fixing roller are damaged, thereby deteriorating the image qualities. Since all the carrier particles adhered to the photoreceptor are not transferred onto a recording medium, the number of carrier particles adhered to the photoreceptor is counted without counting the number of carrier particles adhered to the recording medium.

Specifically, after the 1,000,000-copy running test, a solid toner image with a size of 30 mm×30 mm formed on the photoreceptor of the image forming apparatus RICOH PRO C901 by developing an electrostatic solid image with the developer was visually observed to determine the number of carrier particles adhered to the solid toner image. In this regard, the developing conditions were as follows.

Charge potential (Vd): −600V

Potential of the electrostatic solid image: −100V

Development bias: DC −500V

The carrier adhesion property of the developer is graded as follows.

◎: The carrier adhesion property is of an excellent level.

○: The carrier adhesion property is of a good level.

Δ: The carrier adhesion property is of a usable level.

X: The carrier adhesion property is of an unusable level.

2-(5) Adhesion of Carrier to Line Image

After the 1,000,000-copy running test, two-dot line toner images (100 lines per inch) extending in the sub-scanning direction were formed on the photoreceptor of the image forming apparatus RICOH PRO C901 under the following conditions.

Charge potential (Vd): −600V

Potential of the electrostatic line images: −100V

Development bias: DC −400V (i.e., background potential: 200V)

The two-dot toner images were transferred to an adhesive tape with an area of 100 cm$^2$, and the line toner images on the adhesive tape was visually observed to determine the number of carrier particles on the adhesive tape.

The line image carrier adhesion property of the developer is graded as follows.

◎: The line image carrier adhesion property is of an excellent level.

○: The line image carrier adhesion property is of a good level.

Δ: The line image carrier adhesion property is of a usable level.

X: The line image carrier adhesion property is of an unusable level.

2-(6) Ghost Image

Figure 4A:
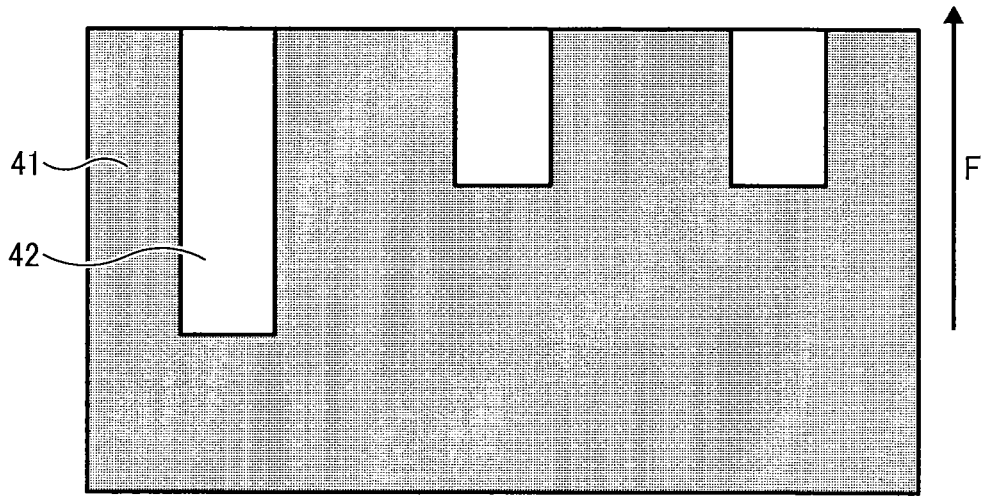
FIGS. 4A and 4B are schematic views for describing ghost images.
Figure 4B:
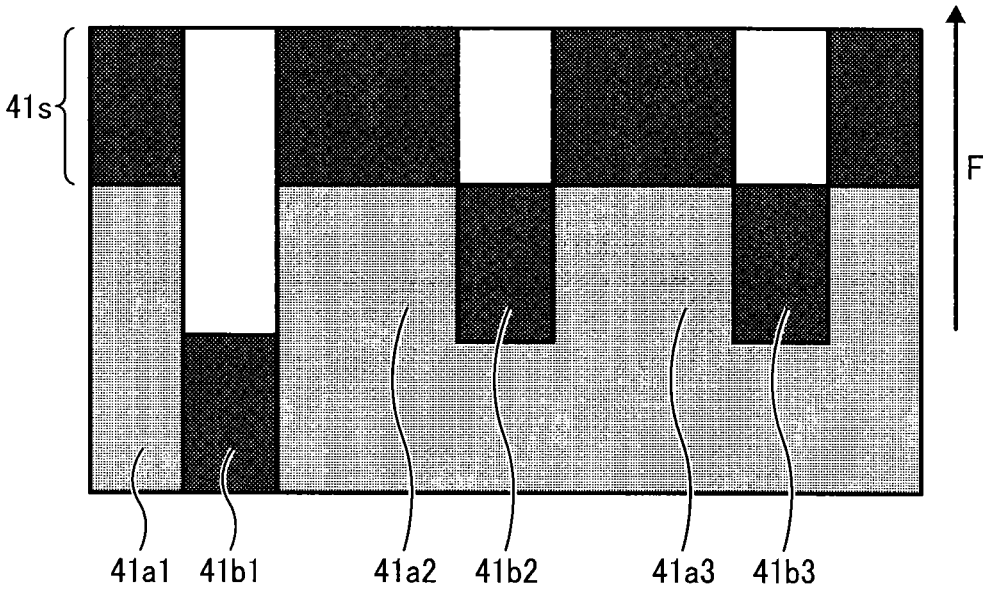

After 100,000 copies of a character image chart in which character images each having a size of 2 mm×2 mm are printed in an image area proportion of 8% were produced using the image forming apparatus RICOH PRO C901, a copy of a vertical stripe image chart, which is illustrated in FIG. 4A and which includes an image area 41 and a non-image area 42, was produced by the image forming apparatus. An image having a ghost image is illustrated in FIG. 4B. In FIG. 4B, numeral 41*s* denotes an image portion which is a front edge portion and whose length in the vertical direction is equal to the peripheral length of the developing sleeve (i.e., the image portion is developed during the developing sleeve is rotated one turn). The image density of an image portion 41*a*1 and the image density of another image portion 41*b*1 adjacent to the first-mentioned image portion were measured to determine the image density difference ΔID. In addition, the image density difference between an image portion 41*a*2 and the image density of another image portion 41*b*2, and the image density difference between an image portion 41*a*3 and the image density of another image portion 41*b*3 were determined. The three data of the image density differences ΔID were averaged to determine the image density difference ΔID of the image illustrated in FIG. 4B. The ghost image property of the developer graded as follows.

◎: The image density difference is not greater than 0.01. (Excellent)

○: The image density difference is greater than 0.01 and not greater than 0.03. (Good)

Δ: The image density difference is greater than 0.03 and not greater than 0.06. (Usable)

X: The image density difference is greater than 0.06. (Unusable)

2-(7) Halo Image

Figure 5A:
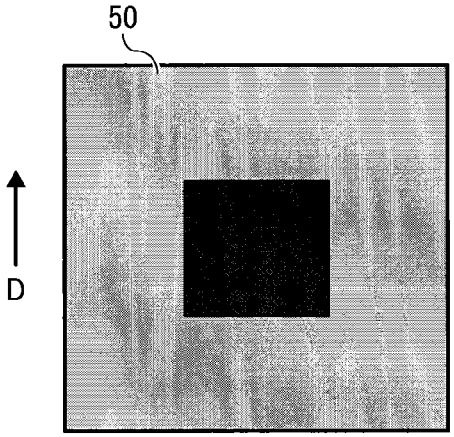
FIGS. 5A and 5B are schematic view for describing halo images.
Figure 5B:
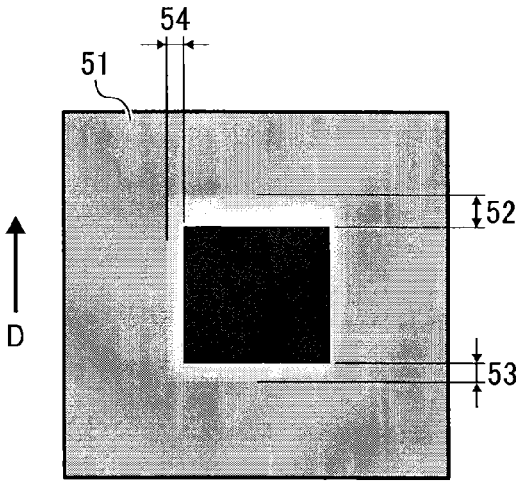

After the 1,000,000-copy running test, a copy of a chart 50, which is illustrated in FIG. 5A and in which a solid image having a higher image density is present in a half-tone image, was produced. The copy (51) is illustrated in FIG. 5B. The width of each of a front halo portion 52, a rear halo portion 53 and a side halo portion 54 was measured. In FIGS. 5A and 5B, character D denotes the developing direction.

The halo image property of the developer is graded as follows.

○: A halo image having a width of not less than 0.1 mm was not formed. (Good)

X: A halo image having a width of not less than 0.1 mm was formed. (Unusable)

The evaluation results are shown in Table 3 below.

TABLE 3

| | Developer | Image density of solid image | Highlight image density | Granularity | Carrier adhesion to solid image | Carrier adhesion to line image | Ghost image | Halo image |
|---|---|---|---|---|---|---|---|---|
| Ex. 1 | 1 | ◎ | ◎ | ◎ | ◎ | ◎ | ○ | ○ |
| Ex. 2 | 2 | ○ | ○ | ◎ | ◎ | ◎ | ○ | ○ |
| Ex. 3 | 3 | ◎ | ◎ | ◎ | ◎ | ◎ | ◎ | ○ |
| Ex. 4 | 4 | ◎ | ◎ | ◎ | ◎ | ◎ | ◎ | ○ |
| Ex. 5 | 5 | ○ | ○ | ◎ | ◎ | ◎ | ◎ | ○ |
| Ex. 6 | 6 | ◎ | ◎ | ◎ | ○ | ○ | ◎ | ○ |
| Ex. 7 | 7 | ○ | ○ | ◎ | ○ | ○ | ◎ | ○ |
| Ex. 8 | 8 | ◎ | ◎ | ◎ | ◎ | ◎ | ◎ | ○ |
| Ex. 9 | 9 | ○ | ○ | ◎ | ◎ | ◎ | ◎ | ○ |
| Ex. 10 | 10 | ◎ | ◎ | ◎ | ◎ | ◎ | Δ | ○ |
| Ex. 11 | 11 | ○ | ○ | ◎ | Δ | Δ | ◎ | ○ |
| Comp. Ex. 1 | 1' | Δ | Δ | ◎ | X | ◎ | ○ | ○ |
| Comp. Ex. 2 | 2' | X | X | ◎ | ◎ | X | ◎ | ○ |
| Comp. Ex. 3 | 3' | ○ | ○ | ◎ | X | ◎ | X | X |
| Comp. Ex. 4 | 4' | X | X | ◎ | ◎ | X | ◎ | ○ |

It is clear from Table 3 that the developers of Examples 1-11 can produce high quality images even after long repeated use. In contrast, at least one of the properties of the comparative developers 1'-4' is of an unusable level.

As mentioned above, since the carrier of this disclosure has a structure such that a relatively large amount of particulate electroconductive material is included in the cover layer of a core, the carrier has a high BET specific surface area. The carrier has a good combination of toner charging ability and toner feeding ability, and the developer including the carrier can produce high quality images with hardly causing a halo image and a ghost image. In addition, since the cover layer of the carrier has good film strength, the carrier has good durability. Further, since the carrier can maintain good charging ability even when environmental conditions change, the developer including the carrier can produce high quality images under various environmental conditions without causing an image density variation problem, a background development problem in that the background area of an image is soiled with toner, and the toner scattering problem. The image forming method and apparatus of this disclosure and the process cartridge of this disclosure, which use the developer of this disclosure, can reliably produce high quality images.

Additional modifications and variations of the present invention are possible in light of the above teachings. It is therefore to be understood that within the scope of the appended claims the invention may be practiced other than as specifically described herein.

What is claimed is:

1. A carrier for use in a two-component developer for developing an electrostatic latent image, comprising:

a particulate magnetic core; and a cover layer located on a surface of the particulate magnetic core and comprising a resin and a particulate electroconductive material, wherein the carrier has a BET specific surface area of from 0.8 to 1.6 $m^2/g$, and the particulate electroconductive material is included in the cover layer in an amount of from 0.016 to 0.04 parts by weight based on 1 part by weight of the particulate magnetic core and the carrier satisfies the following relationship:

$6.0 \leq B1/B2 \leq 8.0$, wherein B1 represents a BET specific surface area of the carrier, and B2 represents a BET specific area of the particulate magnetic core.

2. The carrier according to claim 1, wherein the particulate electroconductive material in the cover layer has an average primary particle diameter of from 0.35 μm to 0.65 μm.

3. A two-component developer for developing an electrostatic latent image, comprising:

the carrier according to claim 1; and a toner.

4. The two-component developer according to claim 3, wherein the toner is a color toner.

5. The two-component developer according to claim 3, used as a supplementary developer, wherein a weight ratio (C/T) of the carrier to the toner (T) is from 1/2 to 1/50.

6. An image forming method comprising:

forming an electrostatic latent image on an image bearing member;

developing the electrostatic latent image with the two-component developer according to claim 3 to form a toner image on the image bearing member;

transferring the toner image to a recording medium; and fixing the toner image to the recording medium.

7. The carrier according to claim 1, wherein the carrier has a BET specific surface area of from 0.9 to 1.5 $m^2/g$.

8. The carrier according to claim 1, wherein the particulate electroconductive material comprises at least one members elected from the group consisting of a metal powder, a powder of titanium oxide, a powder of tin oxide, a powder of zinc oxide, a powder of alumina, a powder of indium tin oxide (ITO), a powder of titanium oxide whose surface is treated with a carbon- or antimony-doped indium oxide, and a powder of alumina whose surface is treated with ITO or phosphorus-doped tin oxide.

* * * * *